US006786854B1

(12) United States Patent
Hsu

(10) Patent No.: US 6,786,854 B1
(45) Date of Patent: Sep. 7, 2004

(54) TRAINING DEVICE FOR BOXING

(76) Inventor: Cheng-Hsiung Hsu, No. 29-18, Ko-Chien Lane, Lu Kang Township, Chang-Hua Hsien (TW)

( * ) Notice: Subject to any disclaimer, the term of this patent is extended or adjusted under 35 U.S.C. 154(b) by 174 days.

(21) Appl. No.: 10/212,179

(22) Filed: Aug. 5, 2002

(51) Int. Cl.[7] ..... A63B 69/34
(52) U.S. Cl. ..... 482/83; 482/87; 482/90
(58) Field of Search ..... 248/116, 163.1, 248/125.8, 161, 410, 411; 482/83–90; 403/300–310

(56) References Cited

U.S. PATENT DOCUMENTS 978,630 A * 12/1910 Oettger
1,463,084 A * 7/1923 Hudson
3,606,409 A * 9/1971 Hawkins, Jr.
4,191,111 A * 3/1980 Emmert
4,807,837 A * 2/1989 Gawlik et al.

* cited by examiner

*Primary Examiner*—Jerome W. Donnelly
(74) *Attorney, Agent, or Firm*—Harrison & Egbert

(57) ABSTRACT

A training device for boxing is formed of a base, an expandable support rod, and a spherical body. The expandable support rod is formed of at least one adjusting member, a lower tubular member, and an upper tubular member which is slidably received in the lower tubular member in conjunction with the adjusting member such that the upper tubular member is located by a seat tube and an upper lock ring of the adjusting member, and such that the lower tubular member is positioned by the seat tube and a lower lock ring of the adjusting member.

1 Claim, 6 Drawing Sheets

TRAINING DEVICE FOR BOXING

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to the sport of boxing and more particularly to a training device for boxing.

BACKGROUND OF THE INVENTION

As shown in FIG. 1, a prior art training device of boxing comprises a spherical body 10, a support rod 11, and a base 12. The spherical body 10 is fastened with the top end of the support rod 11. The support rod 11 is fastened at the bottom end with the base 12 in conjunction with a spring 13. The spring 13 serves to provide the spherical body 10 with a recovery force by means of which the spherical body 10 is able to return to its original position upon being hit by the fists of a boxer. The support rod 11 is made of metal.

Such a prior art training device as described above is limited in design in that the spring 13 is deficient in damping effect.

BRIEF SUMMARY OF THE INVENTION

The primary objective of the present invention is to provide a training device for boxing, which is formed of a base, an expandable support rod, and a spherical body. The spherical body is fastened to the top end of the support rod. The support rod is fastened at the bottom end to the base which is fixed on a surface. The support rod is made of a glass fiber material having an elasticity and is formed of an upper tubular member, a lower tubular member, and an adjusting member disposed between the upper tubular member and the lower tubular member. The bottom end of the upper tubular member is slidably received in the top end of the lower tubular member in conjunction with the adjusting member. The support rod is thus adjustable in length.

DETAILED DESCRIPTION OF THE INVENTION

As shown in FIGS. 2–6, a training device embodied in the present invention comprises a base 20, an expandable support rod 30, and a spherical body 40. The base 20 is fixed on a surface. The expandable support rod 30 is fastened at the bottom end with the top of the base 20. The spherical body 40 is fastened with the top end of the expandable support rod 30. The training device is used by a boxer in such a manner that the spherical body 40 is hit by the fists of the boxer.

Figure 1:
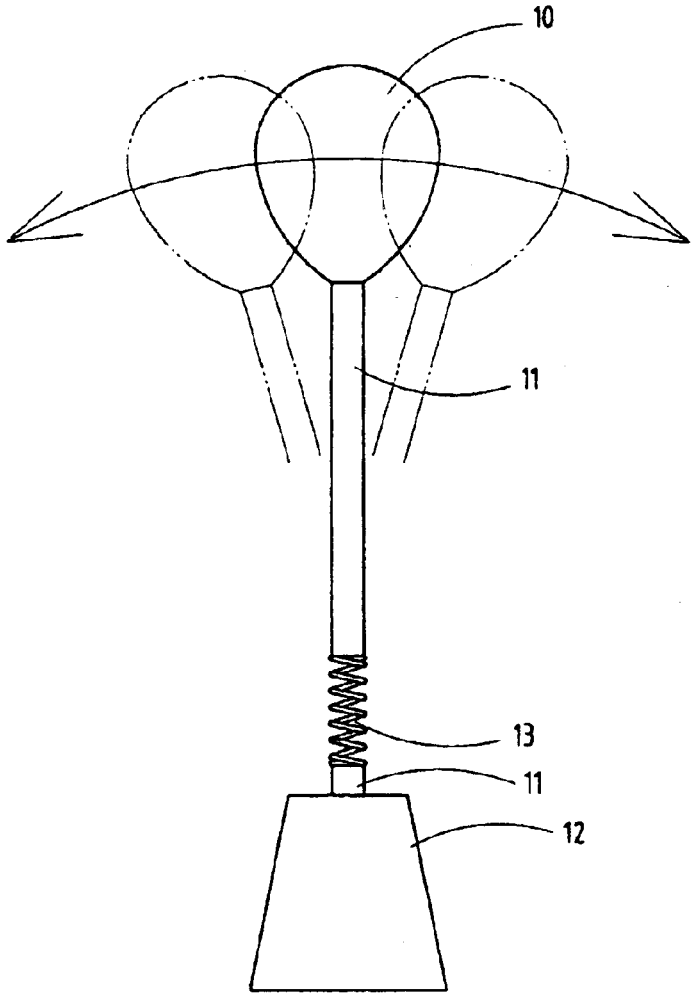
FIG.1 PRIOR ART
FIG. 1 shows a schematic view of a prior art training device of boxing in action.
Figure 2:
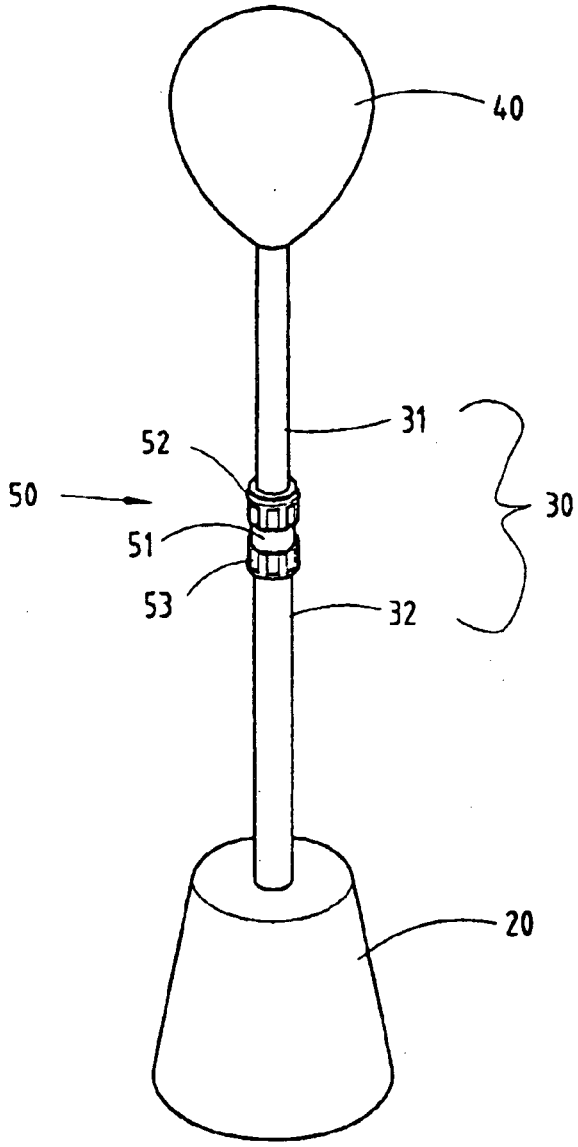
FIG. 2 shows a perspective view of the present invention.
Figure 3:
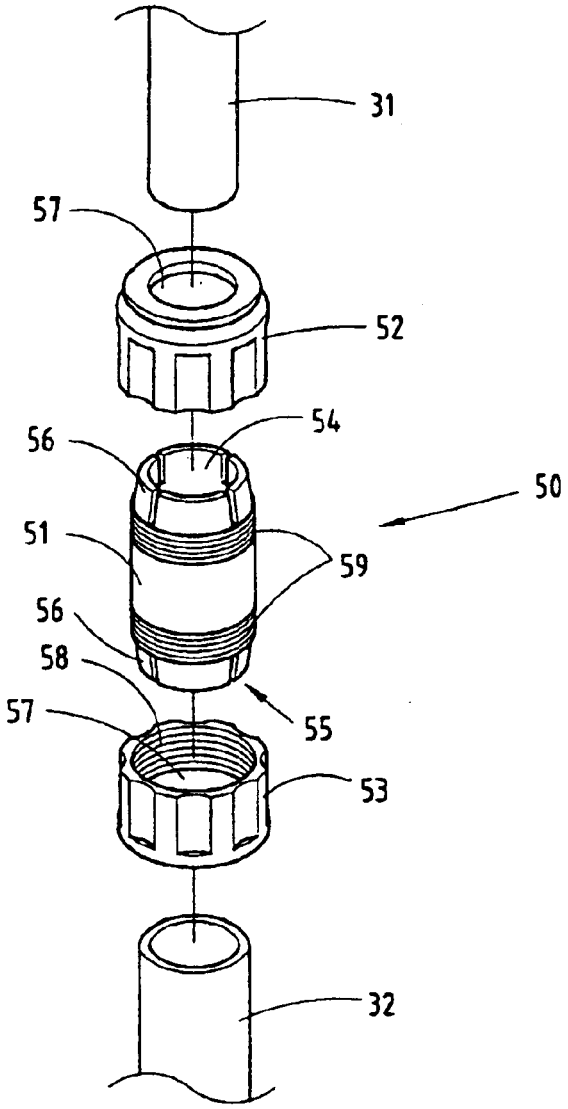
FIG. 3 shows an exploded perspective view of the support rod of the present invention.

The expandable support rod 30 is made of a glass fiber material having an elasticity. The support rod 30 is formed of an upper tubular member 31, a lower tubular member 32, and an adjusting member 50, as shown in FIG. 3. The bottom segment of the upper tubular member 31 is slidably received in the top segment of the lower tubular member 32 in conjunction with the adjusting member 50. As a result, the support rod 30 of the present invention is adjustable in height.

The adjusting member 50 is formed of a seat tube 51, an upper lock ring 52, and a lower lock ring 53. The seat tube 51 is of a hollow construction and is provided at one longitudinal end with an upper end hole 54, and at the other longitudinal end with a lower end hole 55. The seat tube 51 is further provided in the outer wall with two outer threaded portions 59 which are respectively located in proximity of the upper end hole 54 and in proximity of the lower end hole 55. The upper end hole 54 and the lower end hole 55 of the seat tube 51 are formed and defined by a plurality of locating pieces 56 which are made integrally with the seat tube 51. The upper lock ring 52 is provided in the inner wall of the upper end thereof with a locating wall 57 corresponding in location to the locating pieces 56 of the upper end hole 54 of the seat tube 51. The upper lock ring 52 is further provided in the lower end with an inner threaded portion 58 engageable with one of the two outer threaded portions 59 of the seat tube 51. The lower lock ring 53 is provided in the upper end with an inner threaded portion 58 engageable with the other one of the two outer threaded portions 59 of the seat tube 51. The lower lock ring 53 is further provided in the inner wall of the lower end thereof with a locating wall 57 which is corresponding in location to the locating pieces 56 of the lower end hole 55 of the seat tube 51. The upper lock ring 52 and the lower lock ring 53 are basically similar in construction to each other.

The upper tubular member 31, the lower tubular member 32, and the adjusting member 50 are joined together end to end, so as to form the expandable support rod 30 which is adjustable in length by sliding the upper tubular member 31 inside the lower tubular member 32. The lower end segment of the upper tubular member 31 is slidably received in the upper end segment of the lower tubular member 32 in conjunction with the adjusting member 50 such that the lower end segment of the upper tubular member 31 is put through the upper lock ring 52, the seat tube 51, and the lower lock ring 53, and that the upper lock ring 52 is fastened with the upper end of the seat tube 51, and further that the lower lock ring 53 is fastened with the lower end of the seat tube 51. In other words, the joint of the upper tubular member 31 and the lower tubular member 32 are secured by the upper lock ring 52, the seat tube 51, and the lower lock ring 53.

Figure 4:
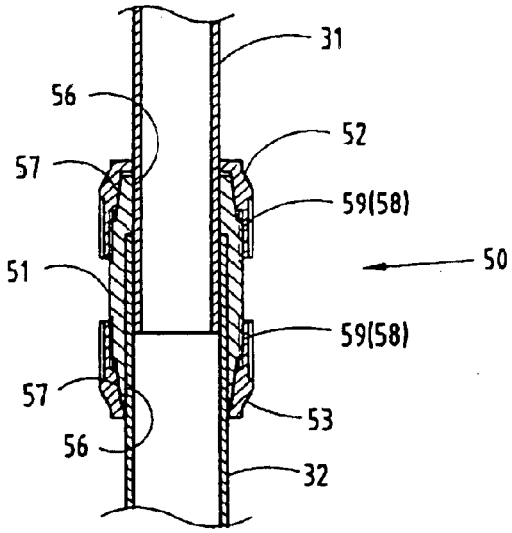
FIG. 4 shows a longitudinal sectional view of the support rod of the present invention.

As shown in FIG. 4, both the upper tubular member 31 and the lower tubular member 32 are securely located in place by the locating pieces 56 of both longitudinal ends of the seat tube 51. The locating pieces 56 of the seat tube 51 are in turn located by the locating walls 57 of the upper lock ring 52 and the lower lock ring 53.

Figure 5:
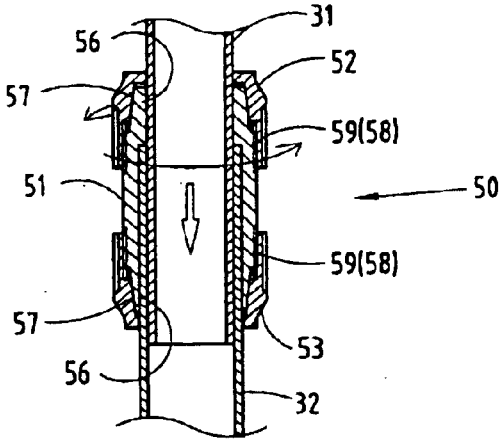
FIG. 5 shows a longitudinal sectional view of the collapsing of the support rod of the present invention.

As shown in FIG. 5, the inner threaded portions 58 of the upper lock ring 52 and the lower lock ring 53 are engaged with the outer threaded portions 59 of the seat tube 51. The length of the support rod 30 of the present invention is adjusted by sliding and locating the upper tubular member 31 inside the lower tubular member 32. The length adjustment is done by first turning the upper lock ring 52 in the counterclockwise direction, so as to loosen the upper tubular member 31 which can be then slid up and down in the inside of the lower tubular member 32.

Figure 6:
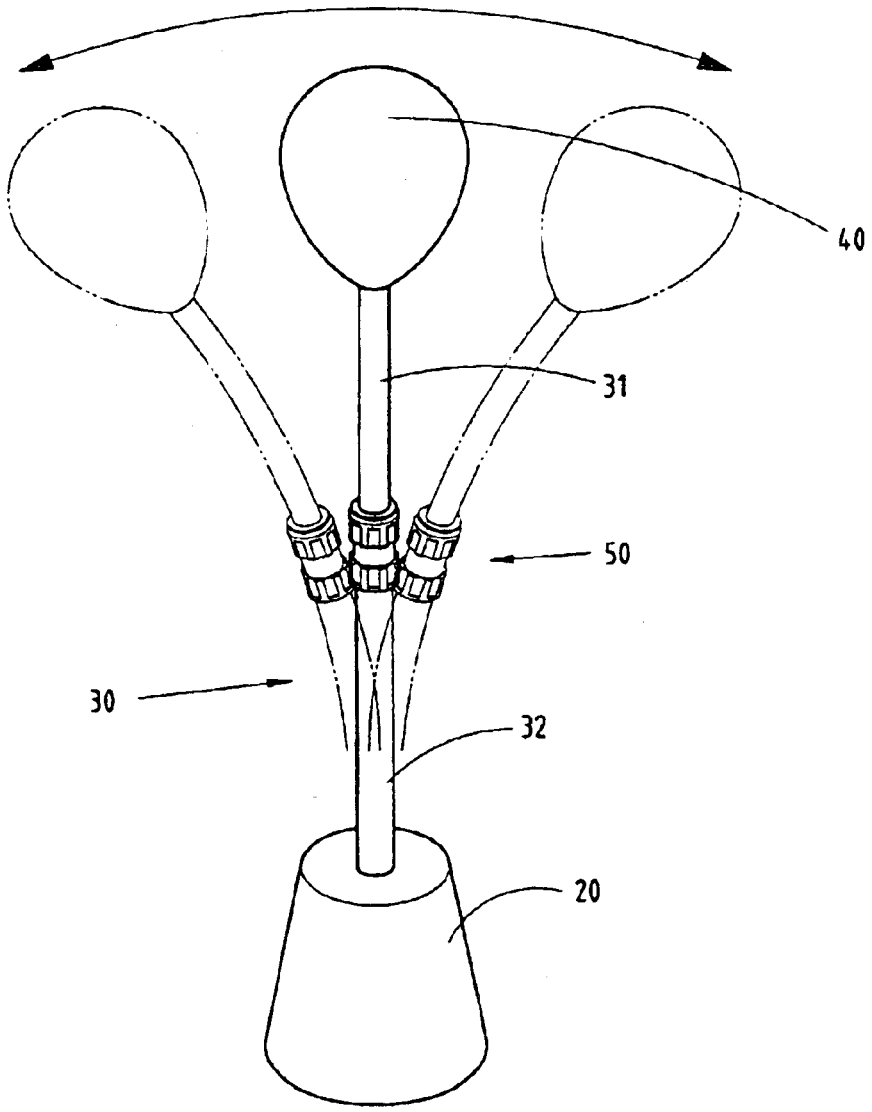
FIG. 6 shows a schematic view of the present invention in action.

In light of the support rod 30 of the present invention being made of a glass fiber material having an elasticity, the support rod 30 is bent in its entirety when the spherical body 40 is hit by the fists of a boxer, as illustrated in FIG. 6. As a result, the support rod 30 of the present invention is superior to the prior art support rod 11 in terms of swiveling effect and damping effect.

It must be noted here that the present invention employs the upper lock ring 52, the lower lock ring 53 and the seat tube 51 in consideration of the fact that the support rod 30 of the present invention is made of a glass fiber material which can not be directly processed by lathe.

Figure 7:
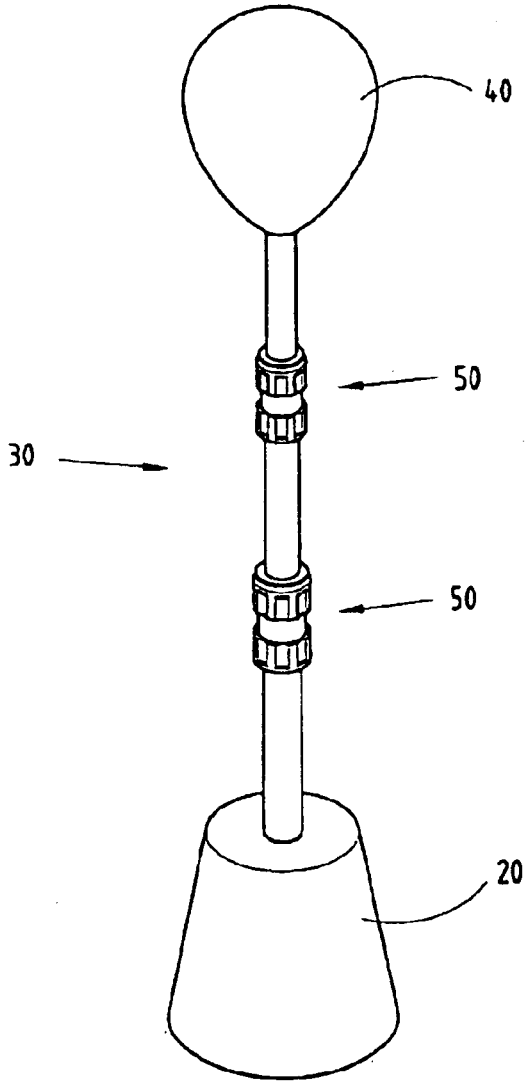
FIG. 7 shows a perspective view of another preferred embodiment of the present invention.

The embodiment of the present invention described above is to be regarded in all respects as being illustrative and nonrestrictive. Accordingly, the present invention may be embodied in other specific forms without deviating from the spirit thereof. For example, the support rod 30 may be provided with a plurality of adjusting members 50, as shown in FIG. 7. The present invention is therefore to be limited only by the scope of the following claim.

I claim:

1. A training device for boxing, said device comprising:

a base fixed on a surface;

a support rod fastened at a bottom end to said base; and a spherical body fastened to a top end of said support rod;

wherein said support rod is comprised of a glass fiber material having an elasticity and is comprised of an upper tubular member, a lower tubular member, and at least one adjusting member disposed between said upper tubular member and said lower tubular member, with a lower segment of said upper tubular member being slidably received in an inside of said lower tubular member which is fastened at a lower end to said base, said adjusting member being comprised of an upper lock ring, a seat tube, and a lower lock ring, said upper lock ring and said lower lock ring being comprised of an inner threaded portion and an inner locating wall, said seat tube being comprised of, in two longitudinal ends, an outer threaded portion and a plurality of locating pieces, said upper lock ring being rotatably fastened to one longitudinal end of said seat tube such that said inner threaded portion of said upper lock ring is engaged with said outer threaded portion of said seat tube, and that said upper lock ring is contiguous to said upper tubular member, said lower lock ring being fastened to another longitudinal end of said seat tube such that said inner threaded portion of said lower lock ring is engaged with said outer threaded portion of said seat tube, and that said lower lock ring is contiguous to said lower tubular member whereby said upper tubular member and said lower tubular member are adjustably fastened together end to end by said adjusting member in such a manner that said upper tubular member is located by said locating pieces of one longitudinal end of said seat tube, and that said lower tubular member is located by said locating pieces of another longitudinal end of said seat tube, with said locating pieces of the one longitudinal end of said seat tube being in turn located by said inner locating wall of said upper lock ring, and with said locating pieces of said other longitudinal end of said seat tube being in turn located by said inner locating wall of said lower lock ring.

* * * * *